US005211393A

United States Patent [19]

Rolffs et al.

[11] Patent Number: 5,211,393

[45] Date of Patent: May 18, 1993

[54] ADJUSTABLE BASKETBALL GOAL

[75] Inventors: Merlan Rolffs; Dennis H. Steenhoek; Dennis E. Brand, all of Pella, Iowa

[73] Assignee: Goalsetter Systems, Inc., Pella, Iowa

[21] Appl. No.: 777,652

[22] Filed: Oct. 16, 1991

[51] Int. Cl.[5] ..... A63B 63/08

[52] U.S. Cl. ..... 273/1.5 R; 248/284

[58] Field of Search ..... 273/1.5 R, 1.5 A; 362/401, 431; 248/292.1, 291, 548, 284

[56] References Cited

U.S. PATENT DOCUMENTS

| | | | |
|---|---|---|---|
| 416,368 | 12/1889 | Jordan | 362/401 X |
| 2,932,511 | 4/1960 | Bemis | 273/1.5 R |
| 2,985,261 | 5/1961 | Kubesh | 362/431 X |
| 3,017,183 | 1/1962 | Calcroft | 273/1.5 |
| 3,355,847 | 12/1967 | Pratt | 362/431 X |
| 3,544,110 | 12/1970 | Dickinson | 273/1.5 R |
| 3,586,324 | 6/1971 | Bearson | 273/1 |
| 3,671,738 | 6/1972 | Beachley | 362/431 |
| 3,765,676 | 10/1973 | Bearson et al. | 273/1.5 R |
| 4,395,040 | 7/1983 | White | 273/1.5 R |
| 4,465,277 | 8/1984 | Dittrich | 273/1.5 R |
| 4,522,394 | 6/1985 | Broussard | 273/1.5 R |
| 4,643,422 | 2/1987 | Cramblett | 273/1.5 R |
| 4,801,142 | 1/1989 | Friesen | 273/1.5 R |
| 4,869,501 | 9/1989 | Anastasakis | 273/1.5 R |
| 4,881,734 | 11/1989 | Nye | 273/1.5 R |
| 4,940,232 | 7/1990 | Chen | 273/1.5 R |

OTHER PUBLICATIONS 8 page U-CAN-JAM! JAM-IT 1990 JAM-IT Marketing, Inc.'s Height-adjustable goal.
2 pages Sam's Unique Features, undated.
1 page Future Pro, Inc. undated.
1 page The Aux-Z, undated.
1 page Full-Court Press, AB1000 undated.

*Primary Examiner*—Paul E. Shapiro
*Attorney, Agent, or Firm*—Zarley, McKee, Thomte, Voorhees & Sease

[57] ABSTRACT

A backboard arm is pivotally mounted to a mast member rearwardly offset from the ground supported mast member in which a jack is internally positioned for extending upwardly out of the upper end for engagement with the backboard arm extending over and outwardly thereof. The jack operates in compression and is substantially concealed from sight.

15 Claims, 2 Drawing Sheets

ADJUSTABLE BASKETBALL GOAL

BACKGROUND OF THE INVENTION

The regulation height for a basketball backboard and rim is too high for small children interested in playing the game. A backboard that is readily adjustable from lower heights to the regulation height is desirable. Backboards that are adjustable in heights are known but involve complicated, unattractive adjustment mechanisms mounted on the outside of the support mast. What is needed is an easily operated, internally mounted adjustment mechanism integrated into the mast of an adjustable basketball goal.

SUMMARY OF THE INVENTION

The mast is hollow and contains a screw jack adjustment mechanism which extends out the top and engages the backboard arms for raising and lowering the backboard. The backboard arms are pivotally connected to a mast member horizontally offset from the ground engaging mast member thereby giving the jack leverage when raising and lowering the lift arms. The jack operates in compression when raising the backboard lift arms and thereby minimizes any risk of injury by the lifting mechanism failing as would be the case in a cable-type operated lifting mechanism.

DESCRIPTION OF PREFERRED EMBODIMENT

Figure 1:
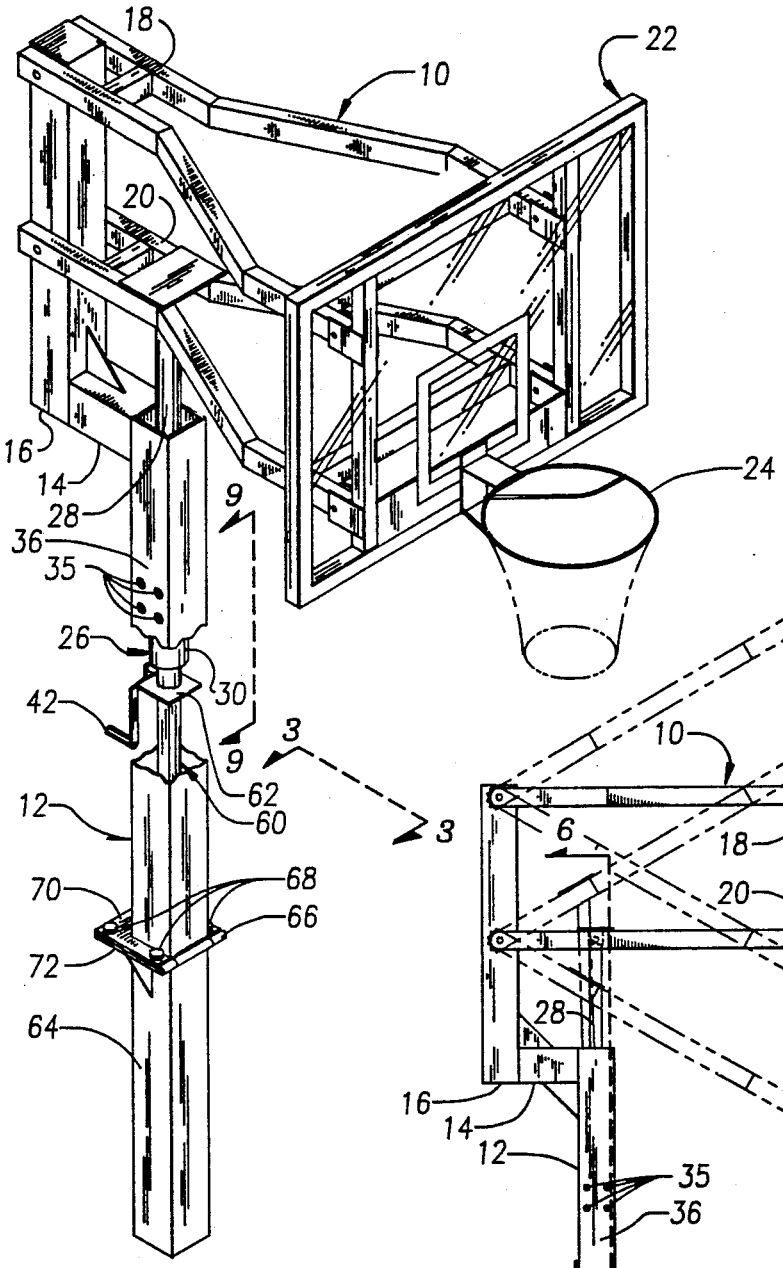
FIG. 1 is a fragmentary perspective view of the adjustable basketball goal.

The adjustable basketball goal of this invention is referred to generally in FIG. 1 by the reference numeral 10 and includes a first hollow mast member 12 to which a horizontal second mast member 14 is connected. A third mast member 16 parallel to the first mast member 12 extends upwardly from the rear end of the second mast member 12 and pivotally supports a pair of vertically spaced apart upper and lower basketball goal yoke arms 18 and 20. The yoke arms 18 and 20 are vertically spaced apart in a parallelogram relationship. The backboard pivot arms are connected to the backboard 22 which includes a basket rim 24.

Figure 8:
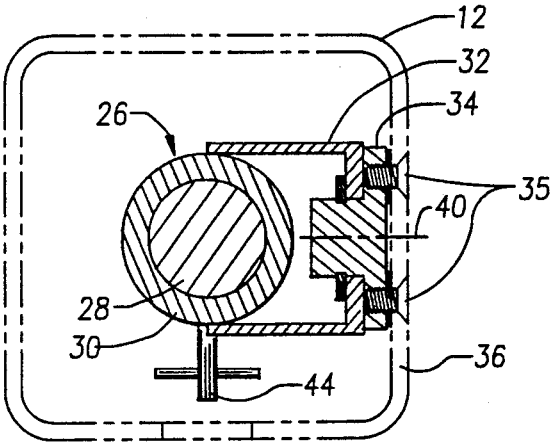
FIG. 8 is a cross-sectional view taken along line 8—8 in FIG. 6.

A screw jack 26 of conventional design is positioned in the hollow first mast member 12 and includes an extendable rod 28 received in a stationery base 30 pivotally connected by a bracket 32 to a pivot pin 34 mounted by screws 35 to the sidewall 36 of the first mast member 12. As seen in FIG. 8 the jack 26 will pivot about an axis 40. The upper end of the extendable rod 28 is connected to the lower backboard arm 20 which extends over and beyond the first mast member 12. It is seen that the hollow first mast member 12 is sufficiently large in cross sectional area to allow the pivoting of the jack 26. A crank handle 42 on the outside of the first mast member 12 is operatably connected to the screw jack 26 by the handle 42 extending through the sidewall 36 of the hollow first mast member 12 and engaging a stem 44.

Figure 2:
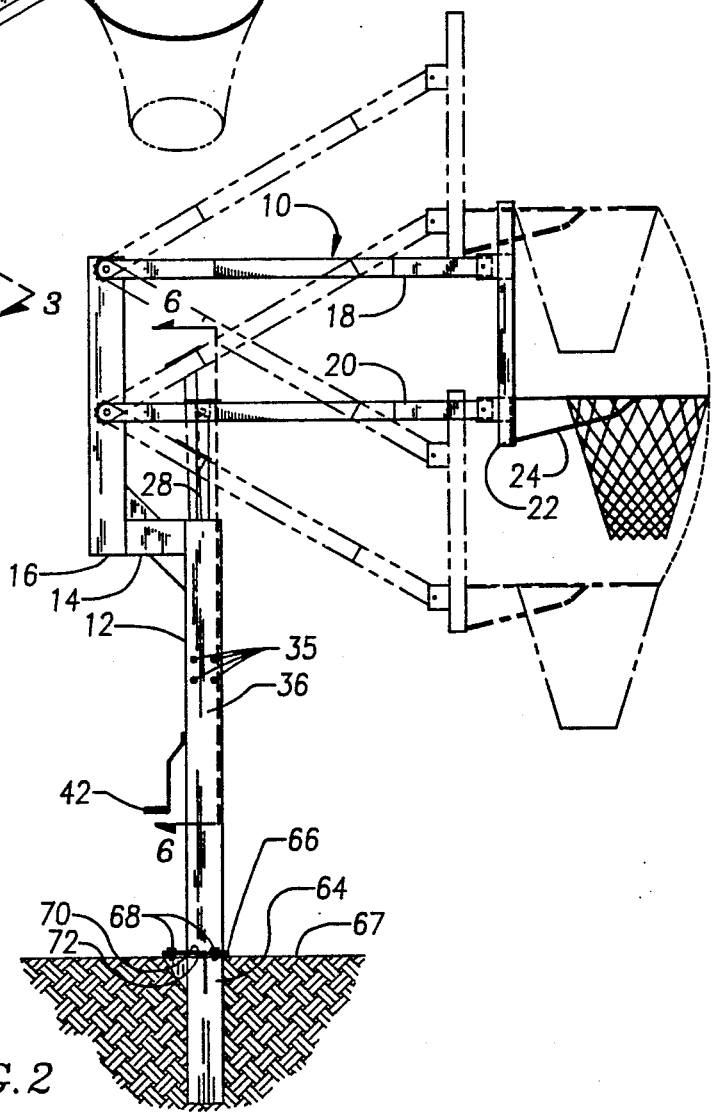
FIG. 2 is a side elevation view thereof showing the adjustable basketball goal in several positions at different heights.
Figure 7:
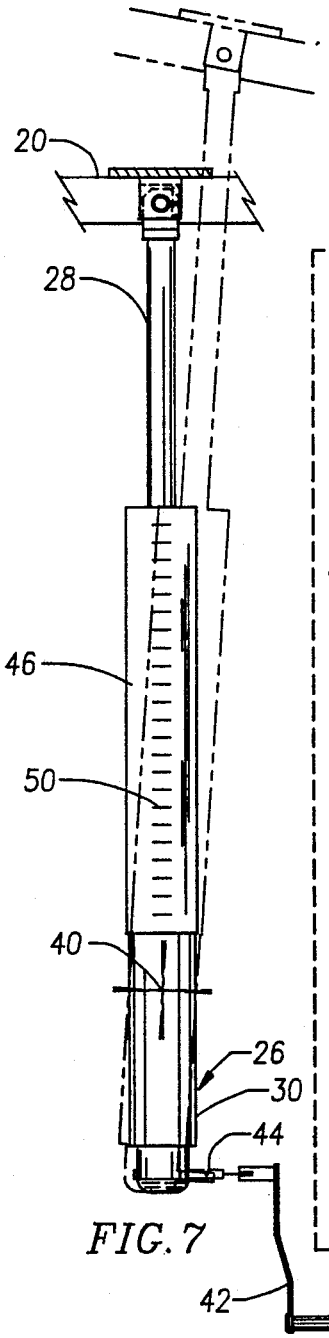
FIG. 7 is a side elevational view taken along line 7—7 in FIG. 6.
Figure 6:
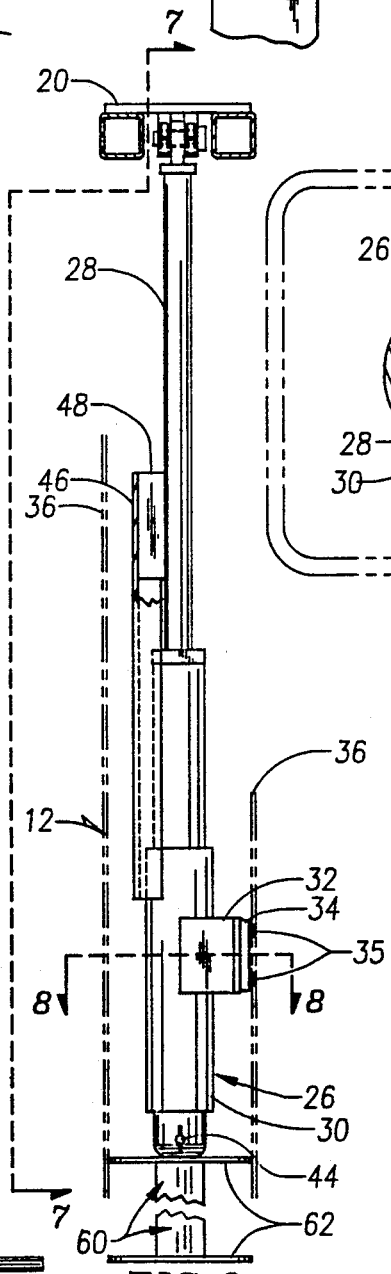
FIG. 6 is a fragmentary side elevational view of the jack inside the mast member.
Figure 9:
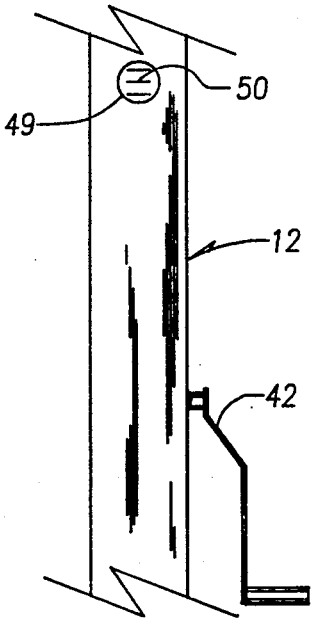
FIG. 9 is a fragmentary side elevational view showing a peep hole in the mast for viewing the height measurement scale carried on the extendable rod of the jack.

A U-shaped display plate 46 is seen in FIGS. 6 and 7 connected by legs 48 to the extendable rod 28 and thus moves with it as it moves up and down as the jack 26 is operated. A peep hole 49 in the sidewall of the first mast member 12 as seen in FIG. 9 exposes for viewing a height measurement scale 50 on the plate 46 and thus visually indicates the relative height of the basket rim 24 which is seen in FIG. 2 in its lowered six foot height position, midway eight foot position and in its upper ten foot height position.

A spacer support post 60 is positioned under the jack 26 as seen in FIG. 1 and extends to the ground and includes plates 62 on opposite ends. It is thus seen that should the jack mounting bracket 32 fail the backboard 22 would not crash down on the users since the jack could not fall within the first mast member 12 as it would be positively supported by the support post 60.

Figure 3:
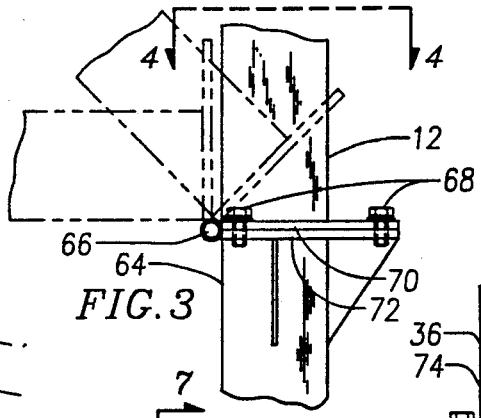
FIG. 3 is a fragmentary side elevational view taken along line 3—3 in FIG. 1 showing the mast pivotal connection to the ground anchor base for erecting the adjustable basketball goal.
Figure 4:
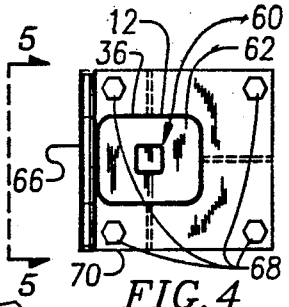
FIG. 4 is a cross-sectional view taken along line 4—4 in FIG. 3.

A fourth mast member 64 is pivotally connected by a hinge 66 to the first mast member 12. The mast member 64 is buried in the ground 67 as seen in FIG. 2 and with the adjustable basketball goal 10 being laid out on the ground horizontally as fragmentally shown in FIG. 3, it can be readily raised to its operable vertical position by pivoting it upwardly from the horizontal dash line position to the vertical raised solid line position. When fully raised bolts 68 are used to connect hinge plates 70 and 72 on the bottom of the first mast member 12 and on the top of the fourth member 64.

Figure 5:
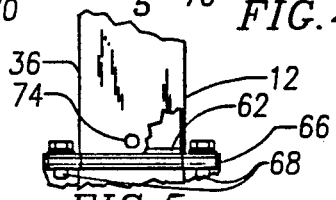
FIG. 5 is a fragmentary side elevational view taken along line 5—5 in FIG. 4.

As seen in FIG. 5, a drain weep hole 74 is located in the sidewall of the first mast member 12.

Thus in operation it is seen that a streamlined in appearance adjustable basketball goal has been provided which is foolproof in operation and includes an internally mounted jack 26 which operates in compression in raising the backboard 22. Through operation of the crank 42 the rim 24 can be positioned as seen in FIG. 2 at any one of an infinite number of height positions. When not in use the crank handle 42 can be removed to further improve the appearance of the structure and avoid unauthorized operation of the jack. Ease of erecting the basketball goal is made possible through the provision of the hinge 66 connecting the bottom base plate 70 of the first mast member 12 to the top base plate 72 of the fourth mast member 64 anchored in the ground.

What is claimed is:

1. An adjustable basketball goal comprising, a mast having, a hollow fist mast member vertically positioned and having top and bottom ends with said bottom end being adapted to be operatively supported on the ground, a second mast member having opposite ends with one end connected to the top end of said first mast member and extending horizontally, a third mast member vertically positioned and having top and bottom ends, said bottom end being connected to the other end of said horizontally extending second mast member, a backboard arm having inner and outer ends pivotally connected at its inner end to said third mast member above said second mast member and extending over and beyond said first mast member, a backboard goal mounted on the outer end of said backboard arm, and a jack having a base substantially totally mounted in said hollow first mast member beneath said backboard arm and including a rigid rod telescopically received in and extendable from said base and extending upwardly out the top of said first mast member and being connected at its uppermost end to said backboard arm at a point remote from the pivotal connection of said backboard arm to said third mast member whereby said backboard arm may be pivotally raised and lowered through a range of heights through extension and retraction of said rod, said rod being free of any support between said first mast member and said backboard arm, and being free of any angularly displaceable or freely slidable joints between its upper end and the jack base.

2. The structure of claim 1 wherein a second backboard arm is pivotally connected to said third mast member in vertically spaced parallel relationship to said first backboard arm thereby forming a parallelogram.

3. The structure of claim 2 and said backboard is connected to the outer free ends of said first and second backboard arms and is positioned and maintained in a vertical plane throughout arcuate movement through said range of heights.

4. The structure of claim 1 wherein said jack is positioned in said first mast member above the ground support and a safety support post is positioned in said first mast member and extends between the lower end of said jack and the ground.

5. The structure of claim 1 wherein a fourth mast member is pivotally connected to the lower end of said first mast member and said fourth mast member is adapted to be anchored in the ground, and said pivotal connections between said first and fourth mast members allows said first mast member to be erected by pivoting it to a vertical position while said fourth mast member is anchored in the ground.

6. The structure of claim 1 wherein said hollow first mast member is large enough in cross section to allow said jack to pivot as said jack is raised and lowered as said backboard arm pivots through an arcuate range of movement.

7. The structure of claim 6 wherein said jack base is pivotally connected to the inside of said hollow first mast member.

8. The structure of claim 7 wherein said pivotal connection between said jack base and the inside of said first mast member includes a pivot pin mounted in a sidewall of said first mast member and a bracket connected to said jack with said bracket being pivotally connected to said pivot pin.

9. The structure of claim 1 and said base is stationary against vertical movement.

10. The structure of claim 9 wherein a height scale is mounted on said extendable rod and moveable therewith to indicate the height of a basket on said backboard above the ground.

11. The structure of claim 10 wherein said hollow first mast member includes a peep opening in a sidewall in alignment with said height scale whereby the height of a basket can be visually determined.

12. The structure of claim 1 said jack is a screw jack and a handle means is removably positioned on the outside of said hollow first mast member with connecting means engaging said stationary jack base through a sidewall of said first mast member.

13. The structure of claim 1 wherein said second mast member is further defined as being perpendicular to said first mast member.

14. The structure of claim 13 wherein said second mast member is further defined as being perpendicular to said third mast member.

15. An adjustable basketball goal comprising, a hollow first mast member vertically positioned and having top and bottom ends with said bottom end being adapted to be operatively supported on the ground, a second mast member having opposite ends with one end connected to the top end of said first mast member and extending horizontally, a third mast member vertically positioned and having top and bottom ends, said bottom end being connected to the other end of said horizontally extending second mast member, a backboard arm having inner and outer ends pivotally connected at its inner end to said third mast member above said second mast member and extending over and beyond said first mast member, a backboard goal mounted on the outer end of said backboard arm, a jack mounted in said hollow first mast member extending upwardly out the top of said first mast member and being connected to said backboard arm at a point remote to tis pivotal connection to said third mast member whereby said backboard arm may be pivotally raised and lowered through a range of heights through operation of said jack, and said jack being positioned in said hollow first mast member above the ground support and a safety support post being positioned in said first mast member and extending between the lower end of said jack and the ground.

* * * * *